US008056173B2

(12) United States Patent
RongBo

(10) Patent No.: US 8,056,173 B2
(45) Date of Patent: Nov. 15, 2011

(54) SOLUBLE THREAD IN THE MANUFACTURE OF FOOTWEAR

(75) Inventor: Hu RongBo, Busan (KR)

(73) Assignee: Nike, Inc., Beaverton, OR (US)

( * ) Notice: Subject to any disclaimer, the term of this patent is extended or adjusted under 35 U.S.C. 154(b) by 750 days.

(21) Appl. No.: 12/180,636

(22) Filed: Jul. 28, 2008

(65) Prior Publication Data

US 2010/0017974 A1 Jan. 28, 2010

(51) Int. Cl.
*A43B 9/02* (2006.01)

(52) U.S. Cl. ..... 12/145; 12/146 C; 12/142 R

(58) Field of Classification Search ..... 12/145, 12/146 C, 146 R, 142 P, 142 R, 142 RS, 142 T
See application file for complete search history.

(56) References Cited

U.S. PATENT DOCUMENTS

| | | | | |
|---|---|---|---|---|
| 5,345,638 | A | 9/1994 | Nishida | |
| 6,423,165 | B1 | 7/2002 | Hishinuma | |
| 2003/0061737 | A1 | 4/2003 | Zhu | |
| 2007/0271822 | A1* | 11/2007 | Meschter | 36/45 |
| 2010/0017974 | A1* | 1/2010 | RongBo | 12/145 |
| 2011/0041359 | A1* | 2/2011 | Dojan et al. | 36/47 |

FOREIGN PATENT DOCUMENTS

| | | |
|---|---|---|
| DE | 515534 | 1/1931 |
| DE | 20307010 | 7/2003 |
| GB | 447977 | 5/1936 |

OTHER PUBLICATIONS

PCT/US2009/051805, International Search Report and Written Opinion, mailed Apr. 16, 2010.

* cited by examiner

*Primary Examiner* — Marie Patterson
(74) *Attorney, Agent, or Firm* — Banner & Witcoff, Ltd.

(57) ABSTRACT

Aspects of the invention relate to the use of soluble thread in the preparation of footwear, in particular athletic footwear. After preparing aspects of the footwear, the soluble thread is dissolved.

23 Claims, 6 Drawing Sheets

SOLUBLE THREAD IN THE MANUFACTURE OF FOOTWEAR

FIELD

The invention relates to the use of soluble thread in the manufacture of footwear.

BACKGROUND

Currently, nylon or polyester threads are overwhelmingly used for slip lasting stitching of athletic footwear, such as long distance running shoes. Such stitching is suitable so long as thick sock liners are used in the shoes and/or thick socks are worn with the shoes. Otherwise, with thin sock liners or thin socks, the wearer can feel the stitching (bumps.)

Increasingly, the shoe wearer, such as a long distance runner, wears thin socks, does not wear socks, and/or does not desire thick sock liners in the shoe. However, if thin socks and/or thin sock liners are used or sock liners are simply left out, the traditional nylon or polyester threads of the stitches irritate the wearer's feet. Thus, it is desired to provide shoes that contain thin sock liners or no sock liners and are suitable to be worn with thin socks or without socks but are also light weight and comfortable to the bare feet of the wearer.

SUMMARY

Aspects of the invention relate to the use of soluble thread in the preparation of footwear, in particular athletic footwear. After preparing aspects of the footwear, the soluble thread is dissolved with water or other appropriate solvent.

DETAILED DESCRIPTION

Figure 1:
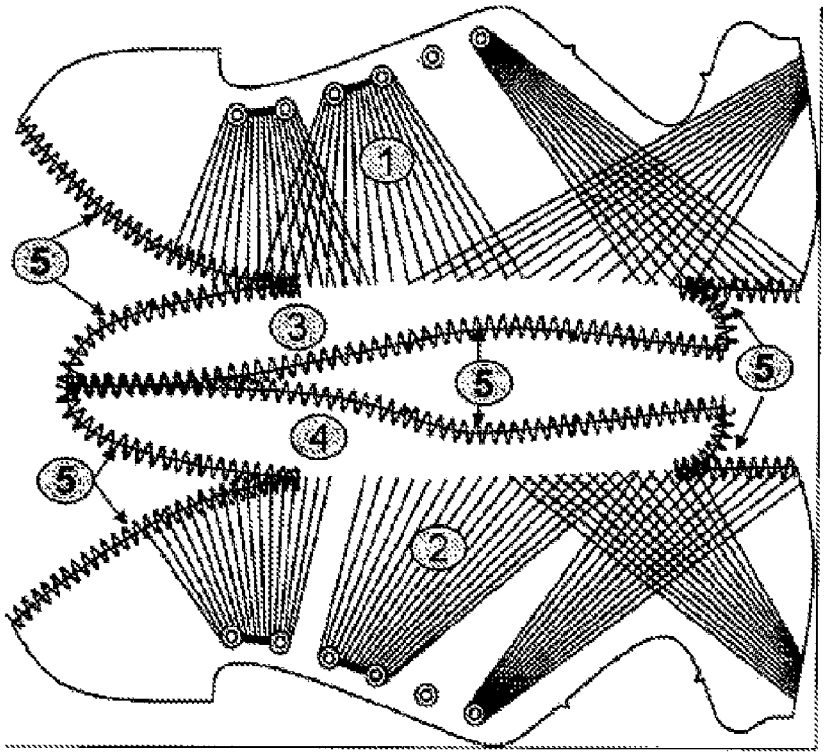
FIG. 1 depicts the use of water-soluble thread on slip lasting construction in accordance with one aspect of the invention.

Soluble thread, in particular, water-soluble thread has been used by the clothing apparel industry for many years. In most cases such thread is used for basting stitching to temporarily hold two pieces of fabric together. This allows machine or manual stitching and/or embroidery. However, soluble thread has not been used for shoe industry.

In accordance with aspects of the invention, soluble thread is used in the assembly of footwear, in particular in the assembly of athletic shoes. The soluble thread may be used in any suitable aspect of preparing shoes, for example soluble thread may be used in traditional slip lasting constructions such as Strobel or California Slip. For instance, the soluble thread is used to stitch together and thus hold the upper and bottom (sock) together during the assembly process. After completion of the assembly, the stitching can be brushed with water or other suitable solvent to remove the thread. The shoes then may be packed and shipped as desired. Shoes with this construction provide a thread-free sock surface for comfortable thin sock or bare foot wearing.

Thus, in accordance with the invention, conventional nylon thread, for example, is replaced with soluble thread for slip lasting or other suitable stitching. The thread may be a water-soluble thread or a solvent-soluble thread.

Water-soluble thread may be any suitable thread that has the strength for stitching and then the ability to dissolve upon the application of water. Vendors, such as Coats plc and YLI Corp provide suitable water-soluble threads.

Although the water-soluble thread is soluble when exposed to water, it still has sufficient holding strength to hold the stitched pieces of the shoe together. For example, the thread has sufficient strength to hold the upper and bottom (strobel, sockliner, or upper extensions) onto the last during assembly process as long as no water is involved until the sole is secured to the upper. Once the upper is secured into the sole with cement bonding, for example, the water-soluble thread is dissolved with water brushing without any negative impact to the durability of the shoe.

The water may be applied at any suitable temperature such as room temperature (approximately 35° C.). Typically warmer water will dissolve the thread quicker. One skilled in the art would use whatever water temperature is appropriate.

The stitching that is exposed is typically removed when water is brushed onto the surface of the threads. Sufficient water is applied to dissolve the exposed threads. If thread remains beneath the surface of the fabric, the ends of such thread is softened and broken down and hence do not provide an irritant to the feet.

Alternatively, the thread may be a solvent-dissolving thread whereby a solvent other than water is applied to remove the thread. Suitable solvent-soluble threads may be any suitable thread that has the strength for stitching and then the ability to dissolve upon the application of a solvent. The solvent should not have any adverse effects to the cement or other adhesive used in securing parts of the shoe such as the upper to the sole. The solvent is applied at a suitable temperature and amounts suitable to dissolve the thread as discussed for water.

Figure 2:
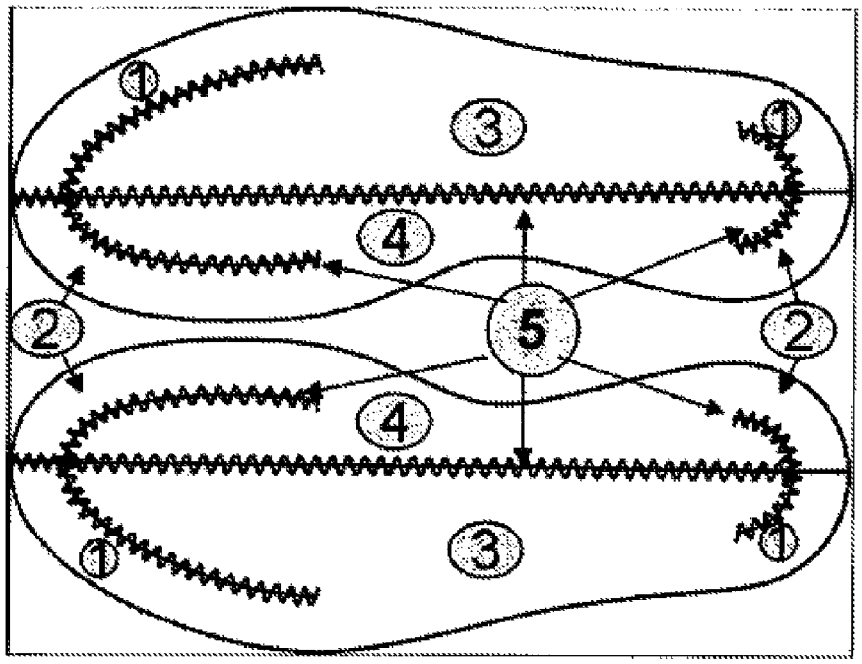
FIG. 2 depicts the bottom view of the aspect of FIG. 1.

Attention is drawn to FIG. 1 and FIG. 2. The upper is closed with water-soluble thread on a traditional stitching machine using slip lasting construction. FIG. 1 depicts a stitched upper having upper lateral 1, upper medial 2, upper lateral extension 3, and upper medial extension 4. Water-soluble thread is used to provide the stitching—depicted as zigzag line 5. FIG. 2 depicts the bottom view of the stitched upper of FIG. 1. The zigzag stitching 5 corresponds to the completed stitched upper prior to removal of the thread.

The upper is then slip closed onto a last. Primer and cement are applied onto the upper in order to bond the upper with the sole. Such bonding practices are within the skill of the art. The base cement may be any suitable solvent-based cement. Water-based cement may be used providing the density and amount of water-based cement applied onto the thread are well controlled. Although somewhat weakened by the water content in the cement, the water-soluble thread can still be strong enough to hold the upper. That is, water-based cement must have minimal dissolution effect on the water-soluble thread in order to maintain the integrity of the thread. The sole is then attached onto the lasted upper. The water-soluble thread is brushed of with water when the shoe is finished.

Figure 3:
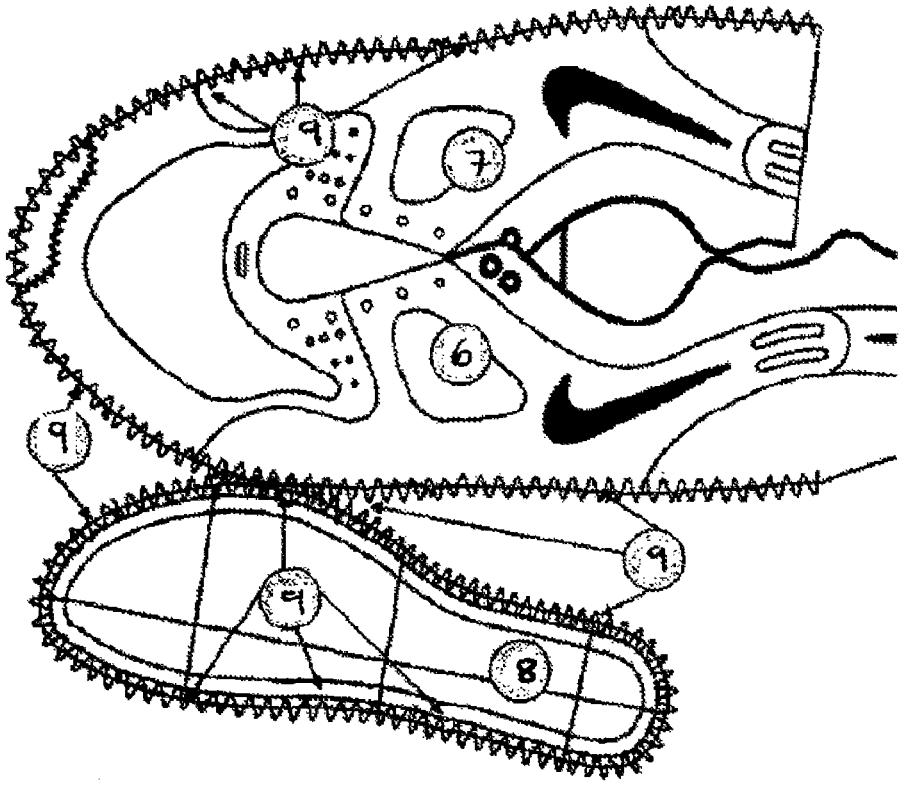
FIG. 3 depicts the use of water-soluble thread on slip lasting construction in accordance with another aspect of the invention.
Figure 4:
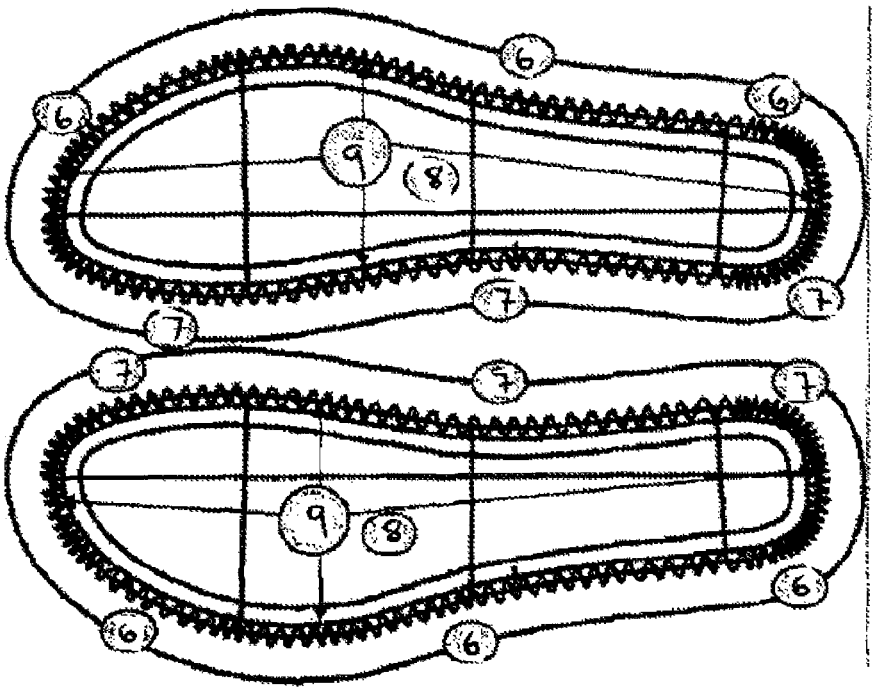
FIG. 4 depicts the bottom view of the aspect of FIG. 3.
Figure 5A:
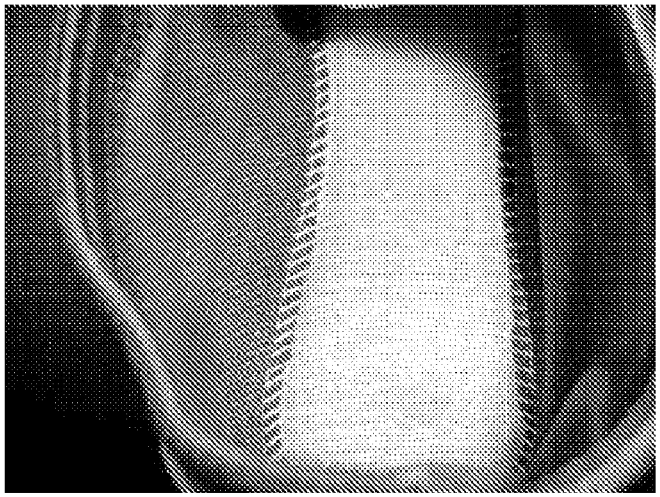
FIGS. 5*a,* 5*b,* 5*c,* and 5*d* depict the steps of using soluble stitching in preparing footwear in accordance with an aspect of the invention.
Figure 5B:
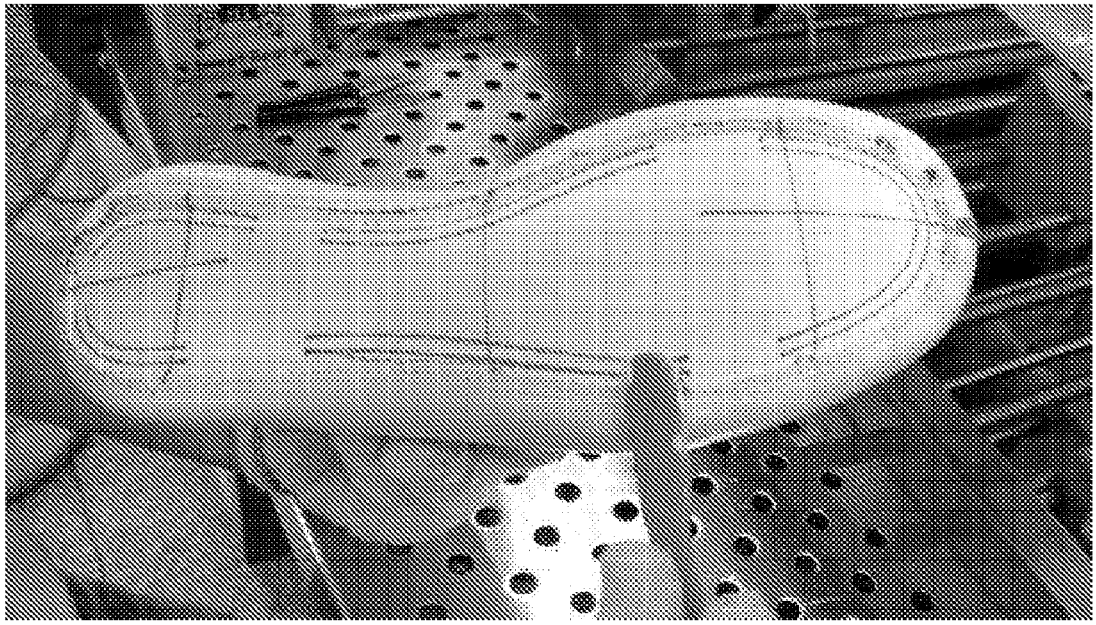
Figure 5C:
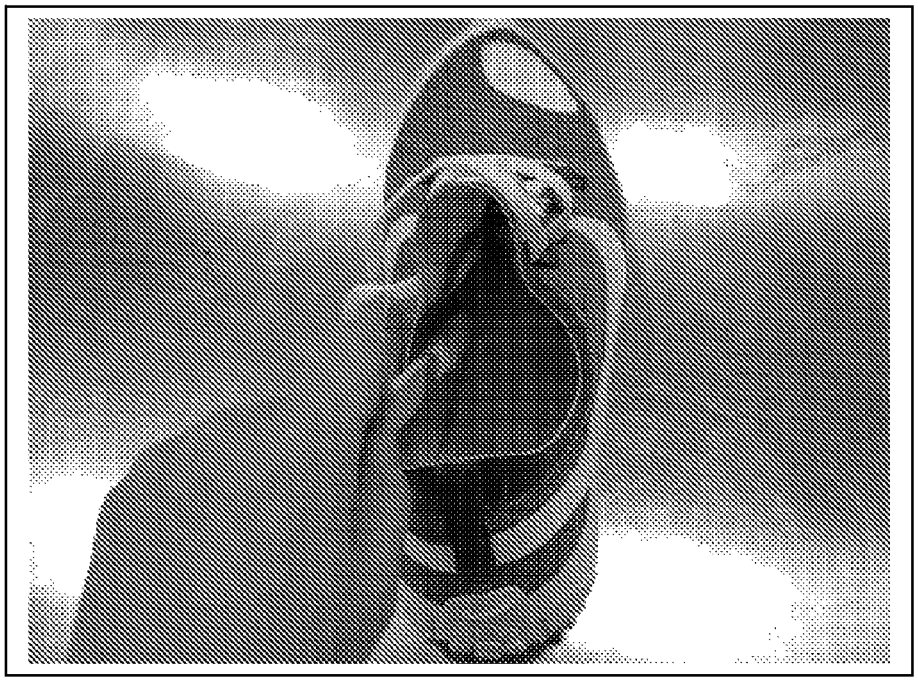
Figure 5D:
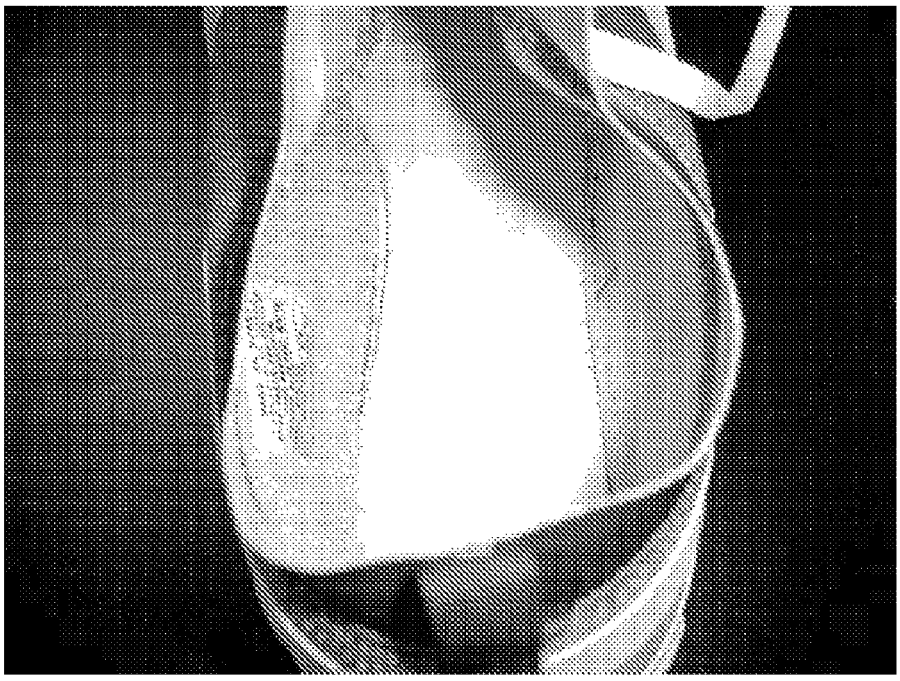

FIG. 3 and FIG. 4 show a stitched upper having a sock or sock liner. A sock liner is applied to an upper of a shoe as conventional except that water-soluble thread is used to attach the liner to the upper. The stitching may be performed in any suitable manner such as with a traditional stitching machine using slip lasting construction. FIG. 3 depicts a stitched upper having upper lateral 6, upper medial 7, and sock or sock liner 8. Water-soluble thread is used to provide the stitching—depicted as zigzag line 9. FIG. 4 depicts the bottom view of the stitched upper of FIG. 3. The zigzag stitching 9 corresponds to the completed stitched upper and sock liner prior to removal of the thread. The upper is secured into the sole with cement bonding, for example. The water-soluble thread is dissolved with water brushing without any negative impact to the durability of the shoe.

In accordance with another aspect of the invention, an insole is stitched with a conventional stitching machine with the water-soluble thread to an upper. See FIG. 5*a*. Primer and/or cement is applied to the perimeter of the upper between the top of the insole and bottom of the upper. See FIG. 5*b*. Then the water-soluble thread is removed with water to allow the insole/sock to be removed from the shoe. This process is shown in FIGS. 5*a-d*. This process allows the weight of the shoe to be reduced and exposes material (i.e., raw outsole) below for improved flexibility and lighter weight.

Although zigzag stitching is shown, any suitable stitch may be used as appropriate.

In addition, solvent soluble thread may be used for upper interior stitching in order to, for example, eliminate the lining. This allows the interior surface of upper to be free of thread irritation after the water soluble thread is brushed off. Again any suitable solvent soluble thread may be used, such as water soluble thread. Eliminating the lining allows the footwear to be made lightweight and at low cost yet provide an interior surface of the upper free of thread friction. An overlay piece may be applied with either nylon thread lap seam or no-sew technology. The water soluble threads are brushed off the water from the back side of the upper.

Figure 6:
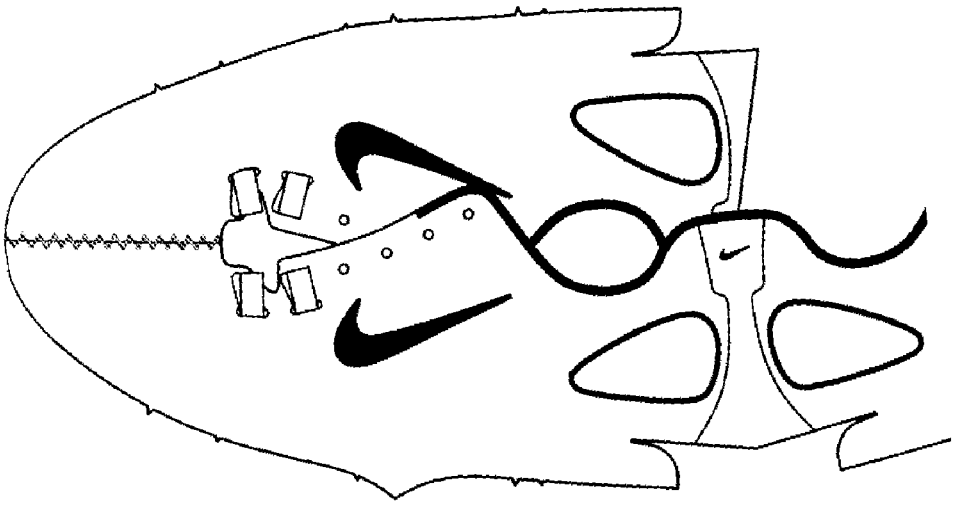
FIG. 6 depicts a stitched medial and lateral upper in the forefront region of the footwear.
Figure 7:
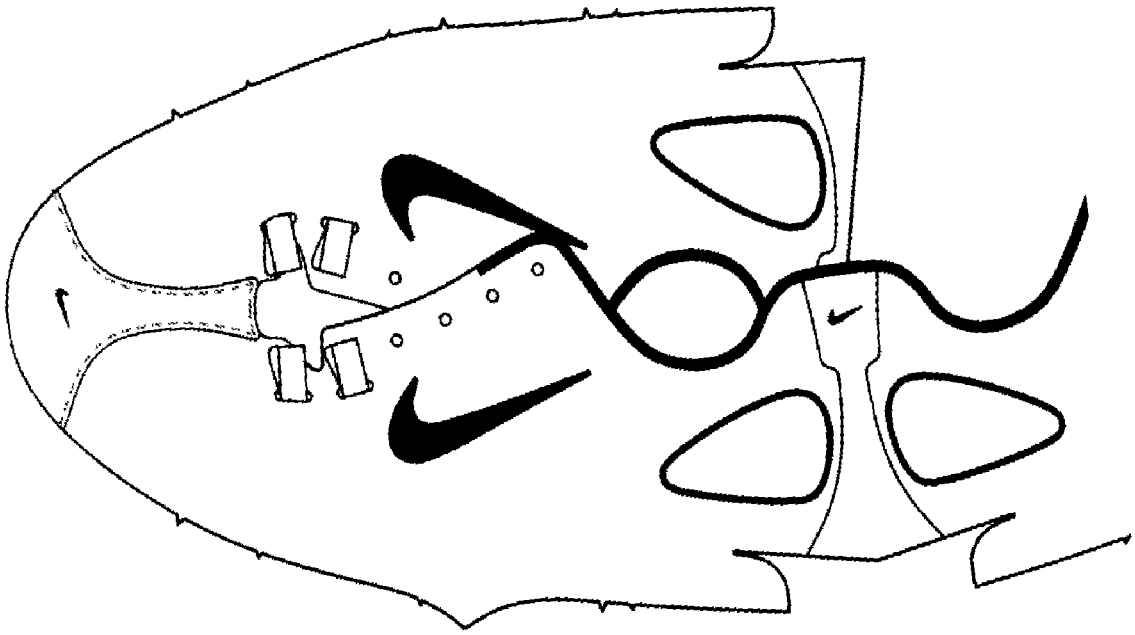
FIG. 7 depicts the stitched medial and lateral upper of FIG. 6 having an overlay toecap piece.

For example, as shown in FIG. 6, two parts of an upper, such as a medial and lateral upper, are stitched together with water soluble thread (see zigzag line). As shown in FIG. 7, a toecap piece is overlayed with either a durable lap seam (nylon thread) (broken line) or with no-sew technology (such as bonded with a thin layer of hot melt film). Subsequently, the water soluble threads are brushed off the water from the back side of the upper. A lining is then not required at the forefoot area.

Figure 8:
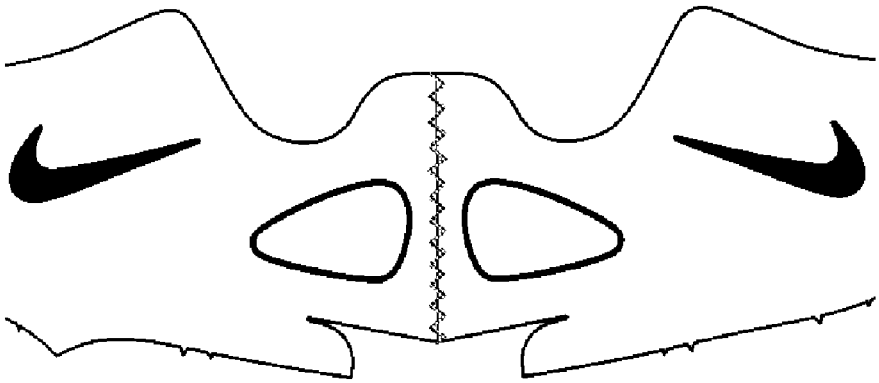
FIG. 8 depicts a stitched medial and lateral upper in the heel region of the footwear.
Figure 9:
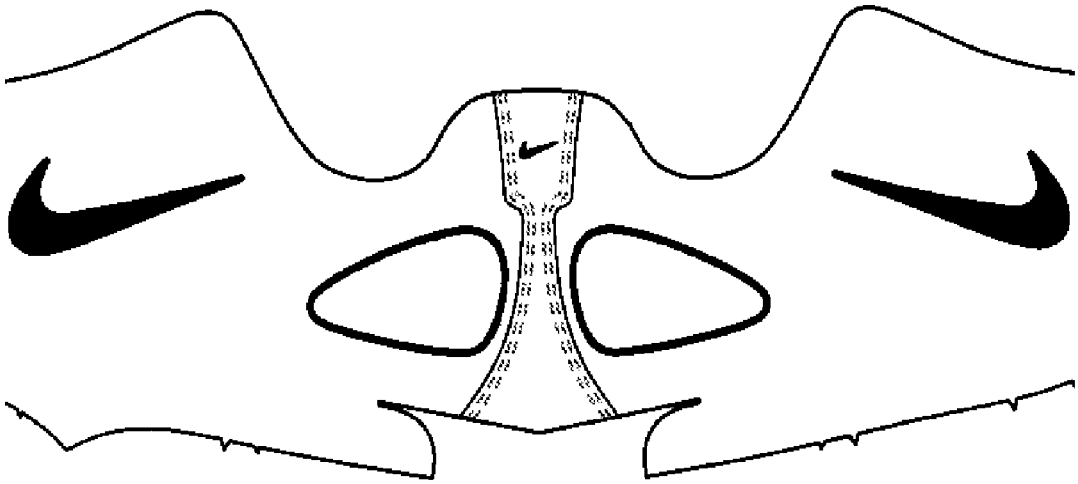
FIG. 9 depicts the stitched medial and lateral upper of FIG. 8 having an overlay piece.

As shown in FIG. 8, two parts of an upper, such as a medial and lateral upper, are stitched together in the heel area with water soluble thread (see zigzag line). As shown in FIG. 9, a overlay piece is overlayed with either a durable lap seam (nylon thread) (broken line) or with no-sew technology (such as bonded with a thin layer of hot melt film). Subsequently, the water soluble threads are brushed off the water from the back side of the upper. A lining is then not required at the heel area.

While the invention has been described with respect to specific examples including presently preferred modes of carrying out the invention, those skilled in the art will appreciate that there are numerous variations and permutations of the above described aspects and techniques that fall within the spirit and scope of the invention as set forth in the appended claims.

What is claimed is:

1. A method of preparing athletic footwear comprising closing an upper by stitching with soluble thread, attaching a sole to the closed upper, and applying a solvent to the soluble thread of the closed upper to dissolve the soluble thread.

2. The method of claim 1 wherein the thread is water-soluble thread and the solvent is water.

3. The method of claim 1 wherein the sole is attached to the upper with cement.

4. The method of claim 3 wherein the cement is solvent-based cement.

5. The method of claim 3 wherein the cement is water-based cement.

6. The method of claim 3 wherein a primer is applied prior to the cement.

7. The method of claim 1 comprising applying the water to the water-soluble thread by brushing.

8. The method of claim 1 wherein the stitching is slip lasting stitching.

9. The method of claim 8 wherein the slip lasting stitching is Strobel or California Slip.

10. Stitch-free athletic footwear prepared by the method of claim 1.

11. A method of preparing athletic footwear comprising stitching a sock to an upper with soluble thread, applying a sole to the upper, and applying a solvent to the water-soluble thread to dissolve the soluble thread.

12. The method of claim 11 wherein the thread is water-soluble thread and the solvent is water.

13. The method of claim 11 comprising applying the water to the water-soluble thread by brushing.

14. The method of claim 11 wherein the stitching is slip lasting stitching.

15. The method of claim 14 wherein the slip lasting stitching is Strobel or California Slip.

16. Stitch-free athletic footwear prepared by the method of claim 11.

17. A method of preparing athletic footwear comprising stitching together a medial upper and a lateral upper with soluble thread, attaching an overlay to an outer side of the stitched upper, and applying a solvent to the soluble thread of an inner side of the stitched upper to dissolve the soluble thread.

18. The method of claim 17 wherein the medial upper and the lateral upper are sewn together in the forefoot region of the footwear.

19. The method of claim 18 wherein the overlay is a toecap.

20. The method of claim 17 wherein the medial upper and the lateral upper are sewn together in the heel region of the footwear.

21. The method of claim 20 wherein the overlay covers the heel region.

22. Stitch-free athletic footwear prepared by the method of claim 17.

23. A method of preparing athletic footwear comprising stitching two parts of the footwear together with water soluble thread, attaching an overlay to an outer side of the stitched footwear, and applying a water to the soluble thread of an inner side to dissolve the soluble thread.

* * * * *